US007540760B1

(12) United States Patent
Chen

(10) Patent No.: US 7,540,760 B1
(45) Date of Patent: Jun. 2, 2009

(54) COMMUNICATION JACK STRUCTURE

(75) Inventor: Chou-Hsing Chen, Keelung (TW)

(73) Assignee: Surtec Industries, Inc., Keelung (TW)

( * ) Notice: Subject to any disclaimer, the term of this patent is extended or adjusted under 35 U.S.C. 154(b) by 0 days.

(21) Appl. No.: 12/203,073

(22) Filed: Sep. 2, 2008

(30) Foreign Application Priority Data

Jun. 18, 2008 (TW) ..... 97210794 U

(51) Int. Cl.
*H01R 4/24* (2006.01)

(52) U.S. Cl. ..... 439/409

(58) Field of Classification Search ..... 439/409, 439/410

See application file for complete search history.

(56) References Cited

U.S. PATENT DOCUMENTS 5,947,761 A * 9/1999 Pepe ..... 439/409
6,406,324 B1 * 6/2002 Duesterhoeft et al. ..... 439/409
6,682,363 B1 * 1/2004 Chang ..... 439/409
2004/0142592 A1 * 7/2004 Peng ..... 439/409

FOREIGN PATENT DOCUMENTS

TW M269631 7/2005

* cited by examiner

*Primary Examiner*—Gary F. Paumen
(74) *Attorney, Agent, or Firm*—Apex Juris, pllc; Tracy M Heims

(57) ABSTRACT

A communication jack structure is adapted for the configuration of a plurality of wires. The communication jack structure includes a base and a terminal pressing member. The base has two rows of piercing terminals, and the terminal pressing member has plural rows of pressing slots corresponding to the piercing terminals respectively. Each pressing slot has an inclined wire leading portion at the opening. The wire leading portion is used for leading the wire from the opening to the bottom of the pressing slot, so as to enhance the efficiency of assembling the wire and the terminal pressing member.

10 Claims, 16 Drawing Sheets

COMMUNICATION JACK STRUCTURE

CROSS-REFERENCE TO RELATED APPLICATIONS

This non-provisional application claims priority under 35 U.S.C. § 119(a) on Patent Application No(s). 097210794 filed in Taiwan, R.O.C. on Jun. 18, 2008 the entire contents of which are hereby incorporated by reference.

BACKGROUND OF THE INVENTION

1. Field of Invention

The present invention relates to an electric signal connector, and more particularly, to a communication jack structure that achieves the wire harnessing easily.

2. Related Art

Terminal connectors are basic parts commonly seen in the electro-communication field. For instance, ROC Utility Model No. M269631 discloses a connector, which is mainly comprised of a housing, a fixed base, and a movable cover, and is adapted to connect an electrical signal line that has multiple cores wrapped therein. The housing has a slot on one end and a fixed base installed on the other end. The fixed base is provided with multiple piercing terminals and multiple corresponding transmission terminals, and each piercing terminal is electrically connected to the corresponding transmission terminal through a circuit board. The movable cover is pivoted to the fixed base, and has multiple embedded slots. The user may put the electric signal line passing through the movable cover, then place the cores in the electric signal line respectively in the corresponding embedded slots on the movable cover, so as to align the position of each core in the electric signal line with that of the piercing terminal on the fixed base. Then, the user lifts and rotates the movable cover towards the piercing terminals to make the movable cover covered on the housing, and thus the cores in the electric signal line will be electrically connected to the piercing terminals on the fixed base.

In Patent No. M269631, besides pressing the cores, the movable cover of the connector also functions for harnessing the cores, so the movable cover is usually referred to as a wire harness structure in the connector. That is to say, during the assembly of the connector, the cores in the electric signal line are first respectively placed in the corresponding embedded slots on the movable cover to ensure a smooth operation of the subsequent assembly. As for the opening manner and configuration of the embedded slots on the movable cover, each embedded slot has two sidewalls extending inwards from the opening and a bottom wall connecting the two sidewalls. The two sidewalls of the embedded slot are perpendicular to the bottom wall, such that the two sidewalls are approximately parallel to each other, and the width of the embedded slot from the opening to the bottom stays the same. However, once the embedded slot is opened in the above even manner, and as the width of the embedded slot is usually slightly smaller than the diameter of the cores, the cores must be first aligned with the corresponding embedded slots, and then forced into the embedded slots respectively. Besides, the number of the cores is large (eight in most circumstances), so the assembly is rather time and energy-consuming.

In order to easily place the cores in the embedded slots on the movable cover, another method of enlarging the width of the embedded slot is also provided in the industry. However, as the number of the cores is quite large, once a core is pulled, other cores will move therewith. Moreover, when one core is placed in an embedded slot, the other cores already embedded therein may fall off from the embedded slots, and thus the assembly efficiency is further reduced. Therefore, it is the problem in urgent need of solutions to provide a wire harness structure for a terminal connector so as to improve the core assembly efficiency.

SUMMARY OF THE INVENTION

Accordingly, the present invention is mainly directed to a communication jack structure, so as to solve the problem of the unsatisfactory assembly efficiency of the wire harness structure of the connector in the prior art.

In order to solve the above problem, a communication jack structure adapted to electrically connect a cable and a plurality of wires is provided. The communication jack structure includes a base, a terminal pressing member, and a cover. The base has an accommodation groove and a slot. The accommodation groove is provided with two rows of piercing terminals, the slot is provided with a plurality of contact terminals electrically connected to the piercing terminals respectively, and the cable is inserted in the slot to electrically connect the contact terminals. The terminal pressing member has plural rows of pressing slots corresponding to the piercing terminals, each pressing slot has a wire leading portion at the opening, and the wire extends into the terminal pressing member along a wire connection direction. The wire leading portion, located in the pressing slot opposite to the wire connection direction, extends from the end edge of the opening of the pressing slot in a direction opposite to the wire connection direction, and meanwhile inclines toward the bottom of the pressing slot. The wire is led by the wire leading portion and placed into the bottom of the pressing slot from the opening. The cover, pivoted to the base, rotates to press the terminal pressing member into the accommodation groove, such that the pressing slots respectively press the wires to be embedded in the corresponding piercing terminals, and the wires are electrically connected to the piercing terminals, respectively. Thus, the cable is electrically connected to the wires through the contact terminals and the piercing terminals.

The present invention may achieve the following effect. As each pressing slot of the terminal pressing member has a wire leading portion, a wire led by the wire leading portion can be successfully placed in the pressing slot during the assembly of the wires to the terminal pressing member. Moreover, the circumstances that it is difficult to place the wires in the pressing slots or the wires may easily fall off from the pressing slots can be avoided, and the overall assembly efficiency of the communication jack is enhanced.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The objectives, structures, features, and functions of the present invention will be illustrated in detail below in the accompanying embodiments.

Figure 1:
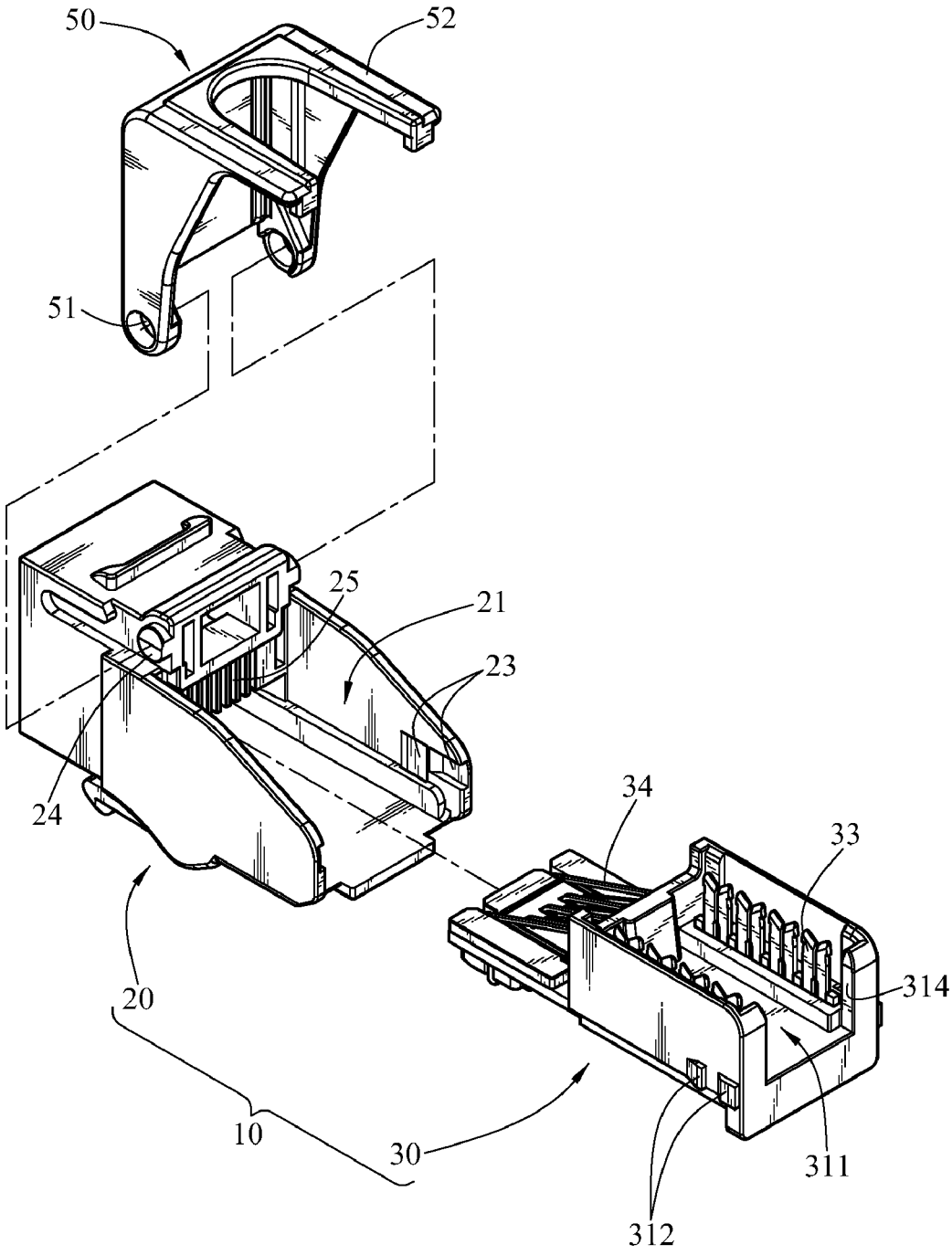
FIG. 1 is an exploded view of a signal communication jack structure according to the present invention.
Figure 12:
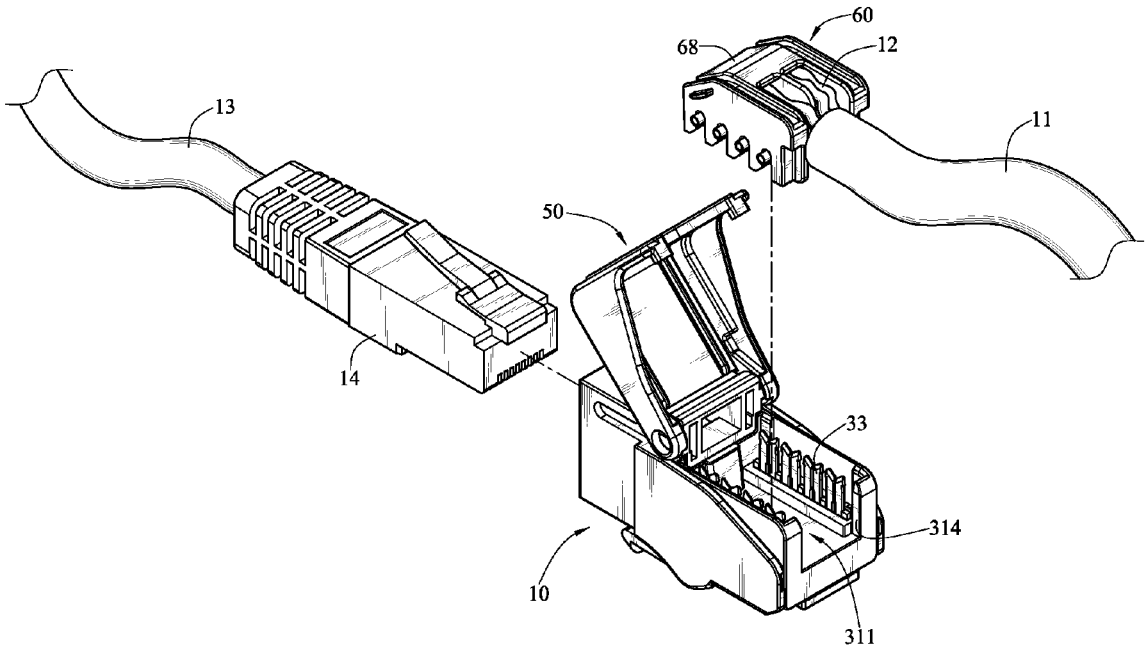
FIG. 12 is an exploded view of a base, a terminal pressing member, and a cable according to the present invention.
Figure 13:
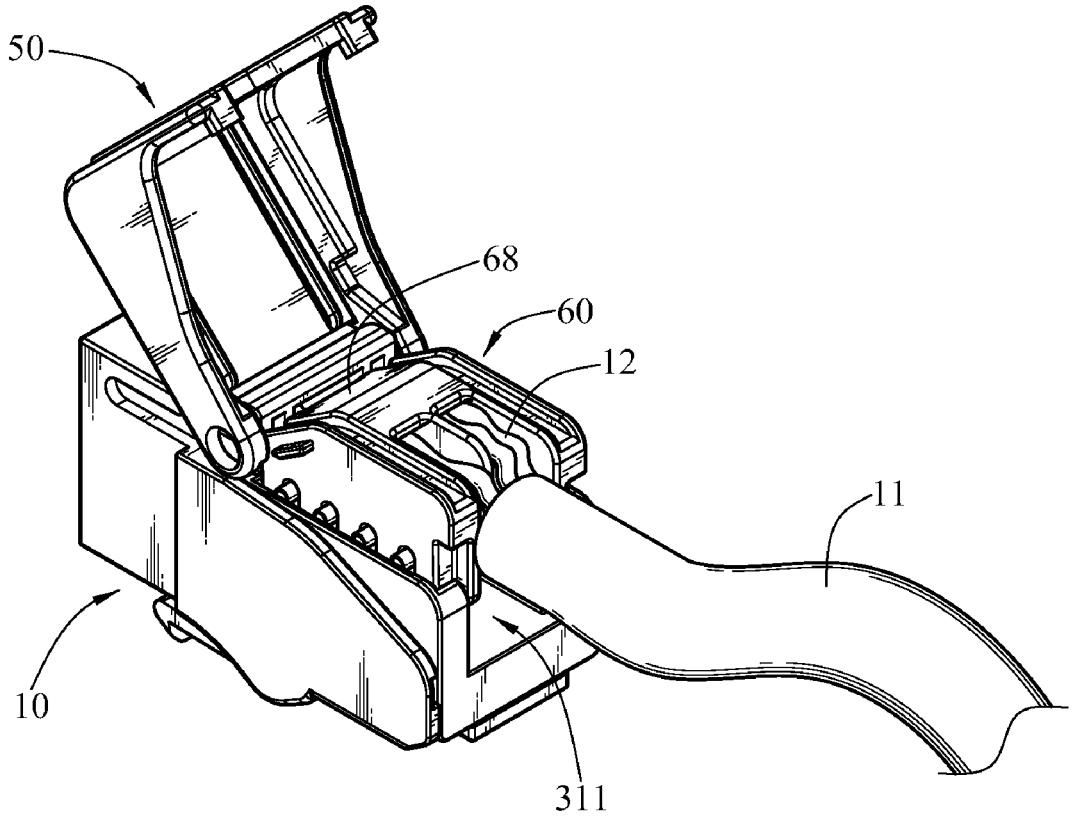
FIG. 13 is a schematic assembly view of a signal communication jack and a cable according to the present invention.
Figure 14:
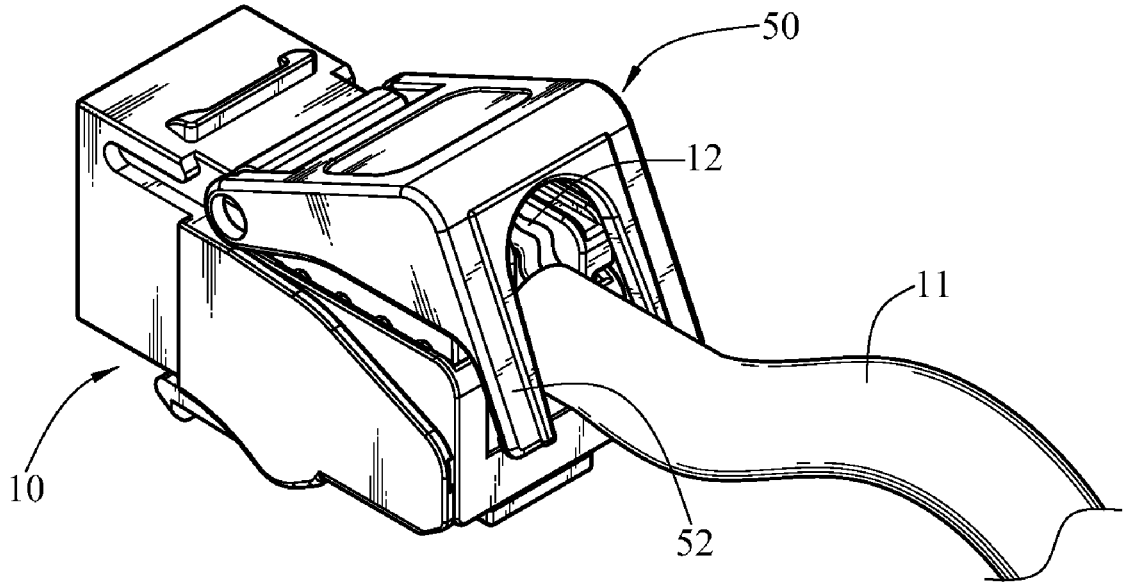
FIG. 14 is a schematic assembly view of a signal communication jack and a cable according to the present invention.
Figure 15:
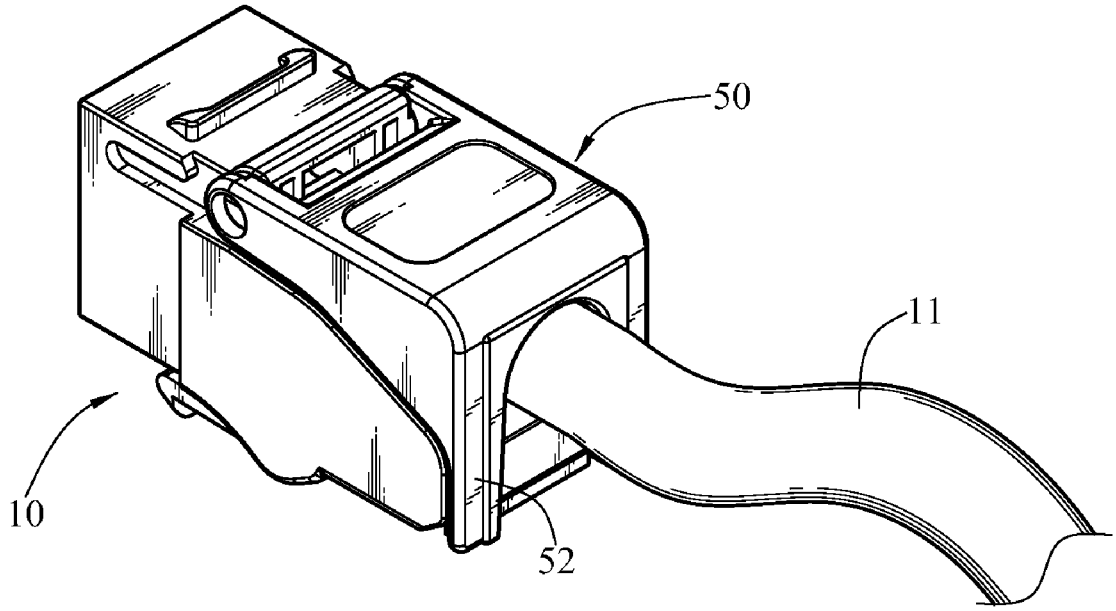
FIG. 15 is a schematic assembly view of a signal communication jack and a cable according to the present invention.
Figure 16:
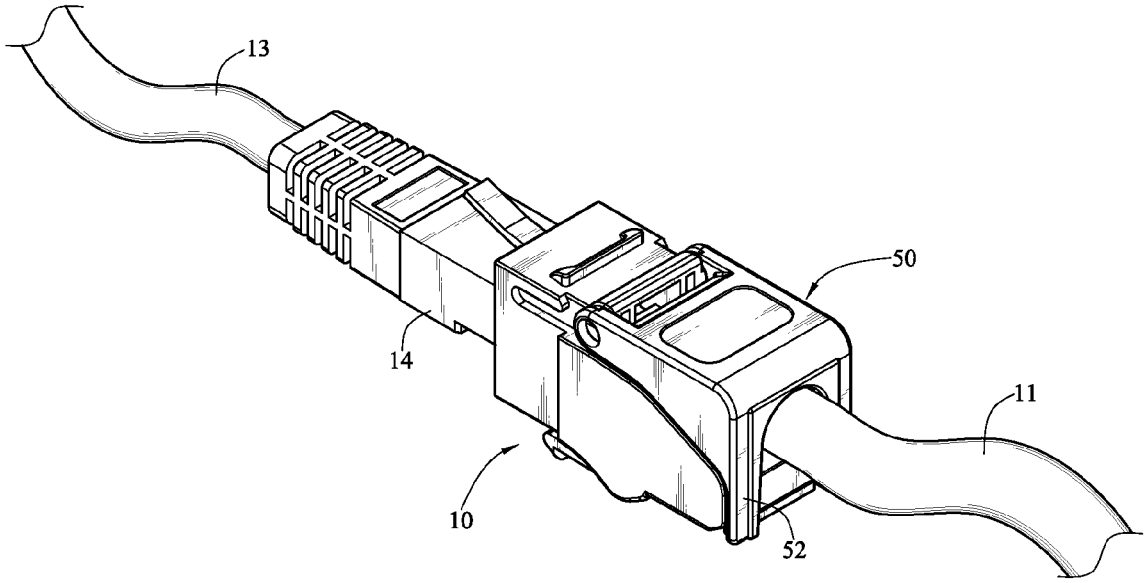
FIG. 16 is a schematic view of a signal communication jack and a cable according to the present invention.

FIGS. 1, 12, and 16 shows a communication jack structure, for electrically connecting a cable 13 with an adapter 14 to a plurality of wires 12 wrapped by a cable 11. The communication jack structure of the present invention includes a base 10, a terminal pressing member 60, and a cover 50.

Figure 2:
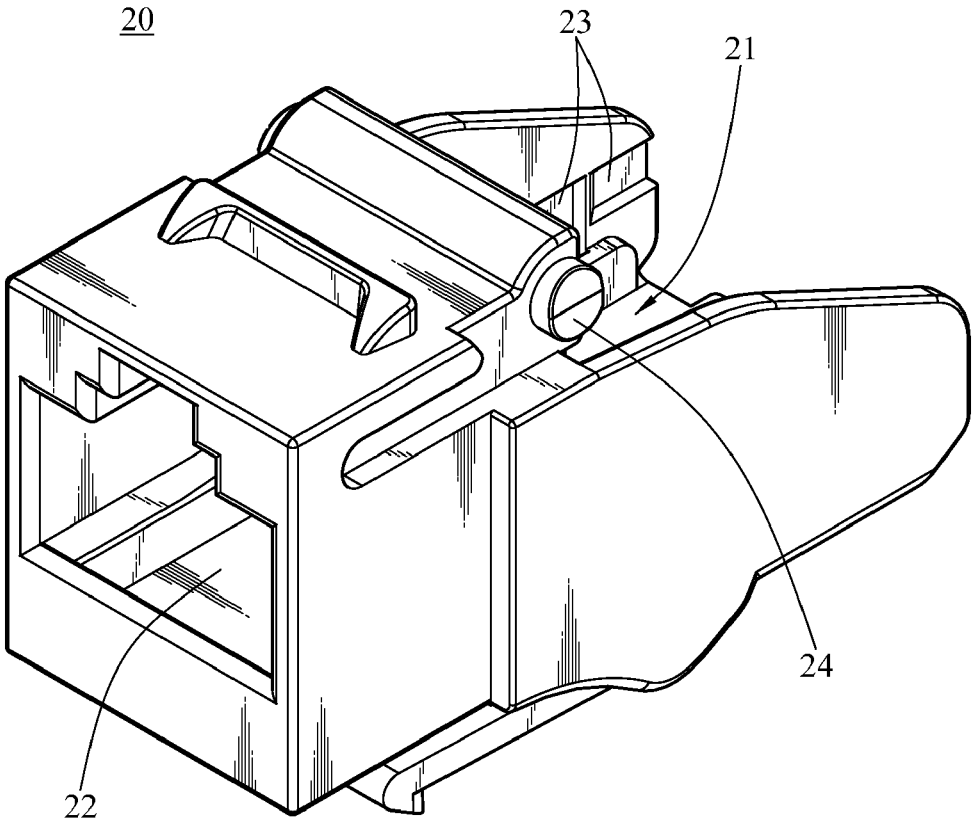
FIG. 2 is a schematic view of an outer housing according to the present invention.
Figure 4:
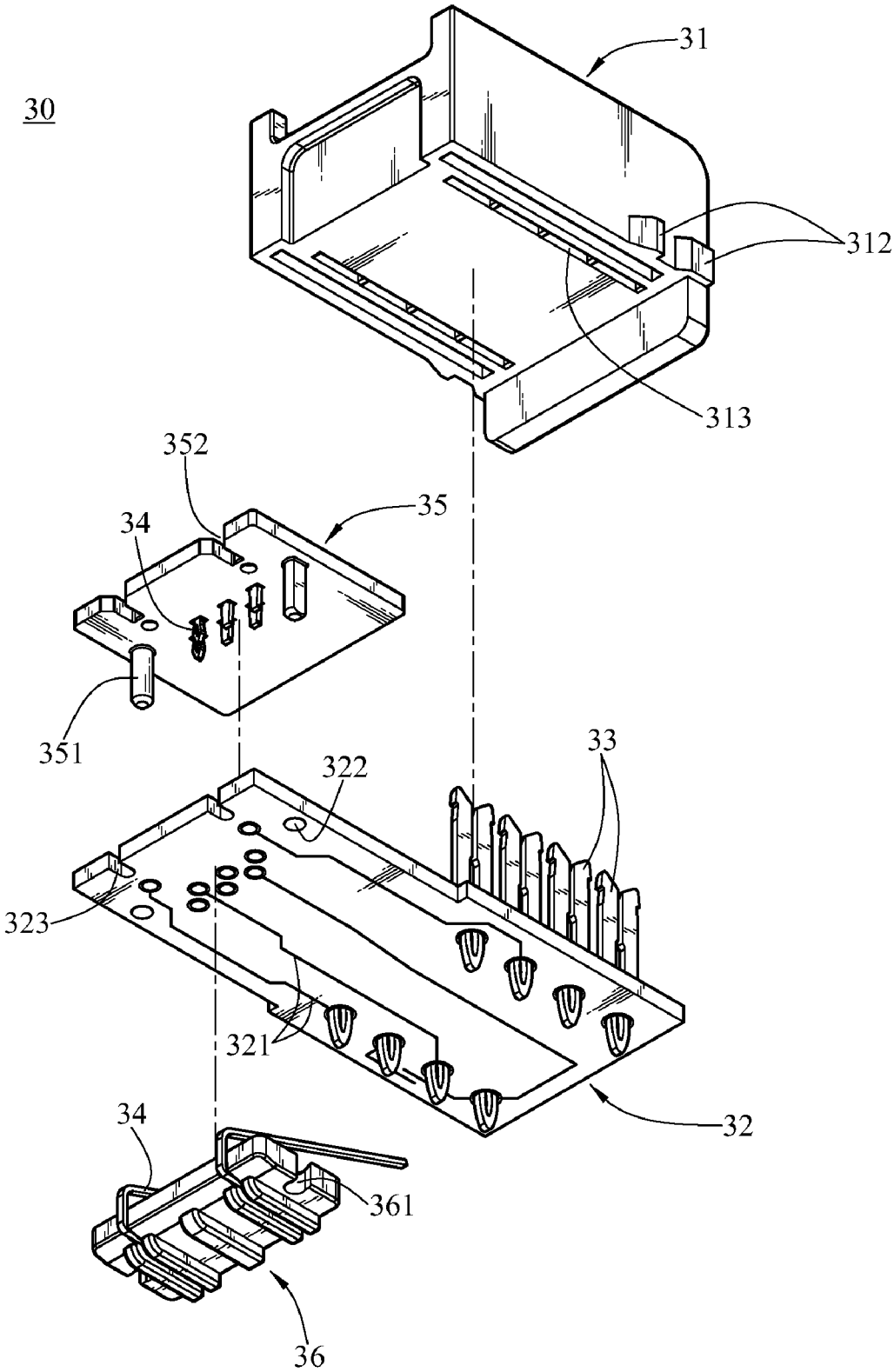
FIG. 4 is an exploded view of a body according to the present invention.

Referring to FIGS. 1, 2, and 4, the base 10 has a body 30 and an outer housing 20 fitted on the body 30. The outer housing 20 has a slot 22 and the body 30 has an accommodation groove 311, such that the base 10 is provided with an accommodation groove 311 and a slot 22. The outer housing 20 further includes an accommodation chamber 21, a plurality of limiting holes 23 arranged in parallel, and two camshafts 24 disposed back to back. The limiting holes 23 are located at two sides of the accommodation chamber 21. The accommodation chamber 21 is communicated with the slot 22, and a plurality of parallel slits 25 is disposed there-between. The body 30 includes an inner housing 31, a circuit board 32, two rows of piercing terminals 33, a plurality of contact terminals 34, an upper combination board 35, and a lower combination board 36. The accommodation groove 311 is enclosed by the inner housing 31, and a plurality of embedded blocks 312 is disposed on two sides of the inner housing 31, so that the body 30 has a plurality of embedded blocks 312. When the body 30 is placed in the accommodation chamber 21 of the outer housing 20, the embedded blocks 312 are respectively embedded into the corresponding limiting holes 23, and thus the body 30 is firmly engaged with the outer housing 20. The inner housing 31 has two ribs 314 respectively located at two side edges of the opening of the accommodation groove 311.

The circuit board 32, the inner housing 31, the upper combination board 35, and the lower combination board 36 are assembled into the body 30. The piercing terminals 33 and the contact terminals 34 are respectively electrically disposed on the circuit board 32, and are electrically connected to each other through a plurality of connection circuits 321 on the circuit board 32. The circuit board 32 has two through-holes 322 and two notches 323. The upper combination board 35 has two latches 351 disposed corresponding to the through-holes 322 and two notches 352 disposed corresponding to the notches 323. The lower combination board 36 has notches 361 disposed corresponding to the through-holes 322. The latches 351 respectively penetrate the through-holes 322 in the circuit board 32 and insert in the notches 361 in the lower combination board 36, so that the upper combination board 35 and the lower combination board 36 are engaged on two sides of the circuit board 32. The two contact terminals 34 on the outer side are assembled on the lower combination board 36, and the rest of the contact terminals 34 are assembled on the upper combination board 35. Each contact terminal 34 has one end disposed on the circuit board 32 and the other end bent towards the inner housing 31. The two contact terminals 34 on the outer side respectively have their middle portions accommodated in the notches 323 and the notches 352. The inner housing 31 has a plurality of through-holes 313 disposed at the bottom corresponding to the rows of the piercing terminals 33. The piercing terminals 33 on the circuit board 32 penetrate the inner housing 31 via the through-holes 313 to enter the accommodation groove 311, and thus the accommodation groove 311 is provided with two rows of piercing terminals 33. After the body 30 is engaged with the outer housing 20, a portion of the circuit board 32, the upper combination board 35, and the lower combination board 36 extend into the slot 22, and the contact terminals 34 are inserted in the slot 22 through the slits 25, such that the slot 22 is provided with the contact terminals 34.

Referring to FIGS. 1, 7, 8, 9, 10, and 11, the terminal pressing member 60 has two pressed blocks 61, two combination boards 62 respectively connected to the pressed blocks 61, a partition board 63 connected to the combination boards 62, two cut-out slots 65, and a contact surface 68. Two parallel through-slots 64 are formed by the combination boards 62 and the partition board 63 between the two pressed blocks 61, and each through-slot 64 obliquely penetrates two sides of the terminal pressing member 60. The cut-out slots 65 are respectively located at an end edge of the pressed blocks 61, and the contact surface 68 is located at the other end of the pressed blocks 61 opposite to the cut-out slots 65. Each pressed block 61 has plural rows of pressing slots 66 corresponding to the piercing terminals 33, and each pressing slot 66 has a wire leading portion 67 at the opening. The wires 12 of the cable 11 extend into the terminal pressing member 60 along a wire connection direction, i.e., a direction from the cut-out slots 65 to the contact surface 68. The wires 12 of the cable 11 penetrate the through-slots 64 in the wire connection direction, and each is led by the wire leading portion 67 and placed to the bottom of the corresponding pressing slot 66 from the opening.

Each wire leading portion 67, located in the corresponding pressing slot 66 opposite to the wire connection direction, extends from the end edge of the opening of the pressing slot 66 in a direction opposite to the wire connection direction, and meanwhile inclines toward the bottom of the pressing slot 66. The pressing slot 66 has a short sidewall 664 connected to the wire leading portion 67, a long sidewall 663 facing the short sidewall 664, and a bottom wall 665 connecting the short sidewall 664 and the long sidewall 663. The long sidewall 663 faces the wire connection direction, and the short sidewall 664 is in an opposite direction. Due to the configuration of the wire leading portion 67, the pressing slot 66 is divided into a holding section 662 adjacent to the bottom wall 665 and a guiding section 661 adjacent to the wire leading portion 67. The width of the holding section 662 is slightly smaller than the diameter of each wire 12, such that once inserted in the holding section 662, the wire may not easily fall off from the pressing slot 66. The width of the guiding section 661 narrows down from the opening of the pressing slot 66 toward the holding section 662, so as to lead the wire 12 from the guiding section 661 to enter the holding section 662. Taking practical demands into consideration, the proportion of the wire leading portion 67 to the pressing slot 66 must be restricted to fulfill the efficacies of the wire leading portion 67. Therefore, in the present invention, a ratio between the length of the wire leading portion 67 projected on the long sidewall 663 and the length of the long sidewall 663 is in a range of 0.3 to 0.7. For example, in FIG. 9, the ratio is 0.5.

Thus, in order to assemble the wires 12 to the terminal pressing member 60, the end of each wire 12 must first penetrate the through-slot 64 and bend toward the corresponding pressing slot 66 in the pressed block 61 on either side, so that the wire 12 may easily enter the guiding section 661 of the pressing slot 66. Afterwards, the wire 12, pulled by a user toward the holding section 662, may easily enter the holding section 662 with the help of the wire leading portion 67, and is further fixed to the holding section 662 of the pressing slots 66. It should be noted that, due to the configuration of the wire leading portion 67, multiple wires 12 may be bent and placed by the user in advance in the guiding sections 661 of the pressing slots 66, and then pulled into the holding sections 662 from the two sides of the terminal pressing member 60. This efficacy is superior to the conventional connector, and the configuration of the wire leading portion 67 may greatly reduce the time for assembling the wires 12.

Figure 3:
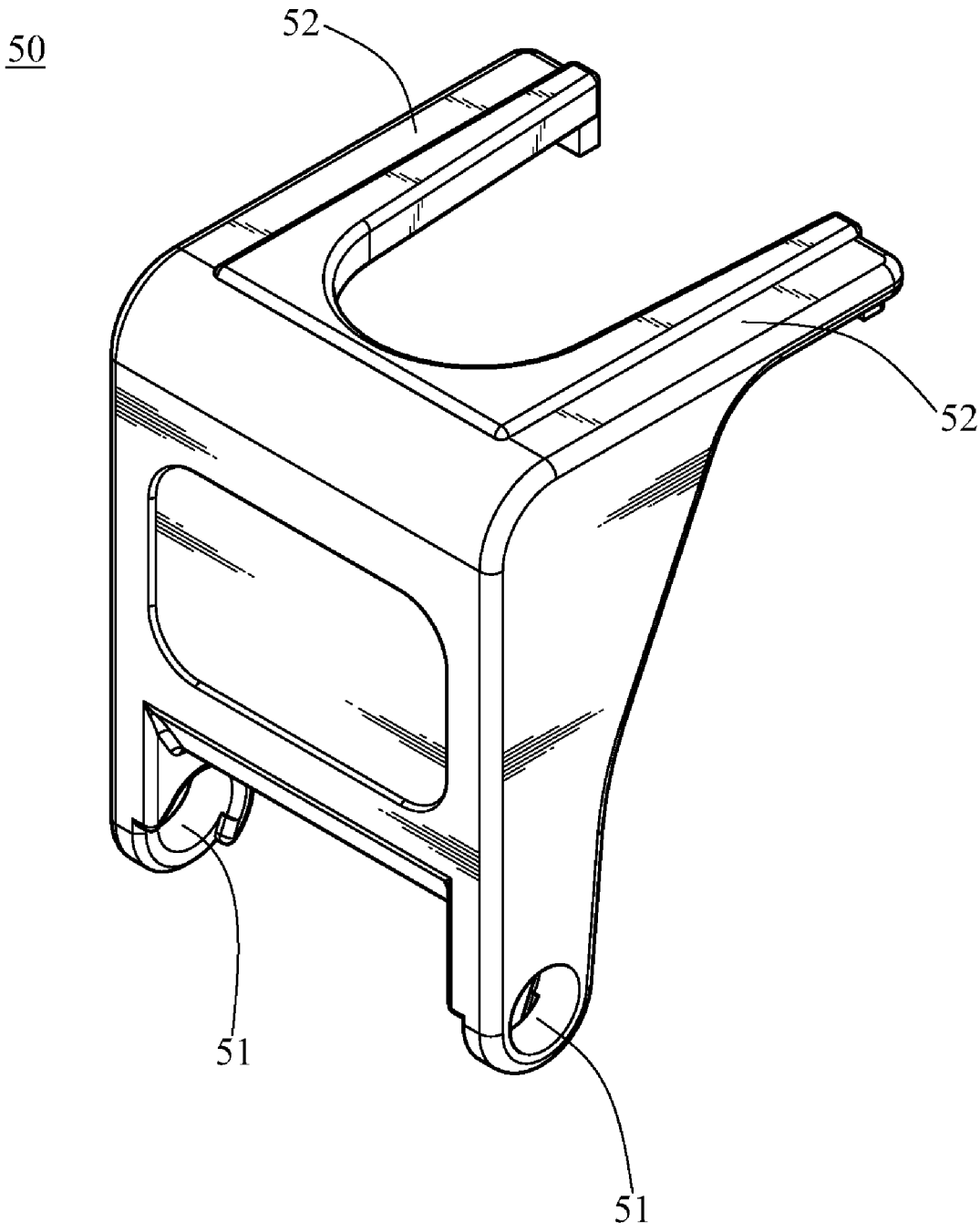
FIG. 3 is a schematic view of a cover according to the present invention.
Figure 5:
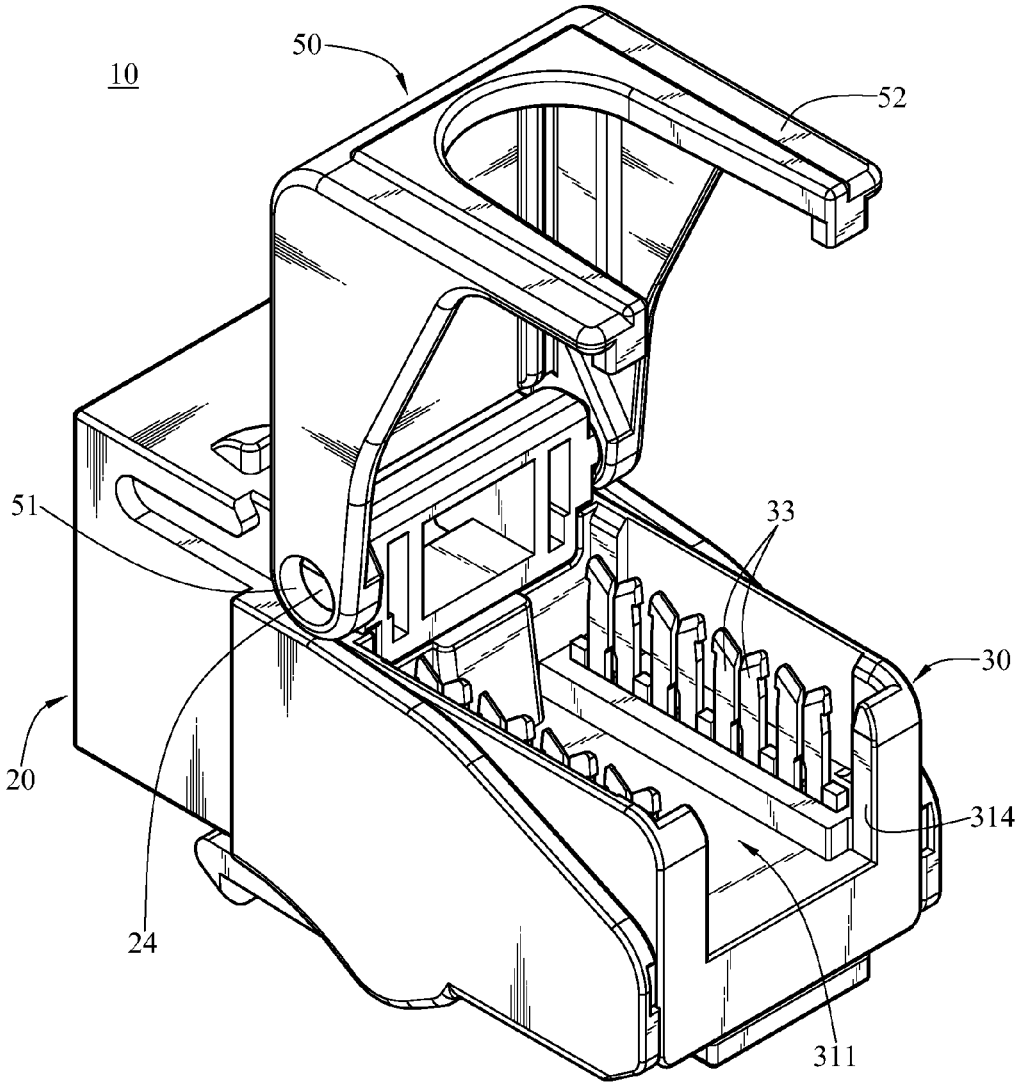
FIG. 5 is a schematic view of a signal communication jack according to the present invention.
Figure 6:
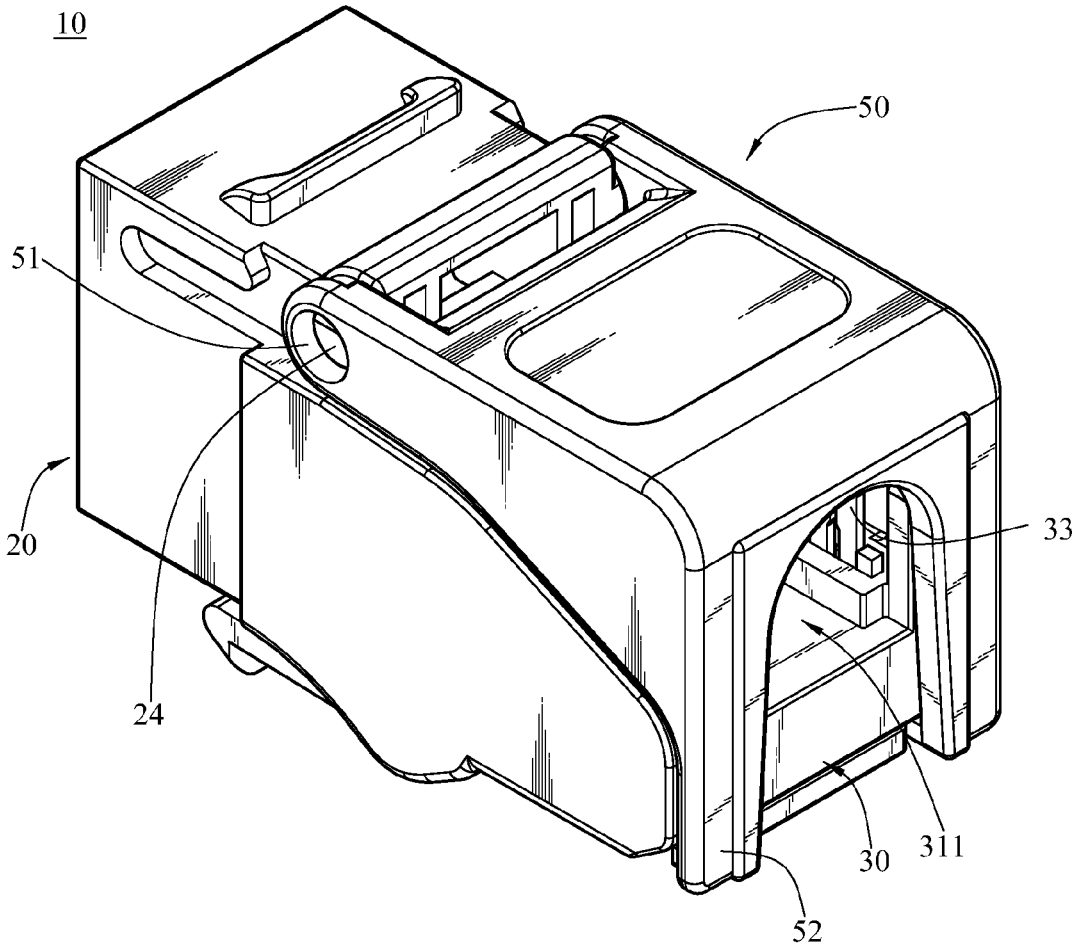
FIG. 6 is a schematic view of a signal communication jack according to the present invention.
Figure 7:
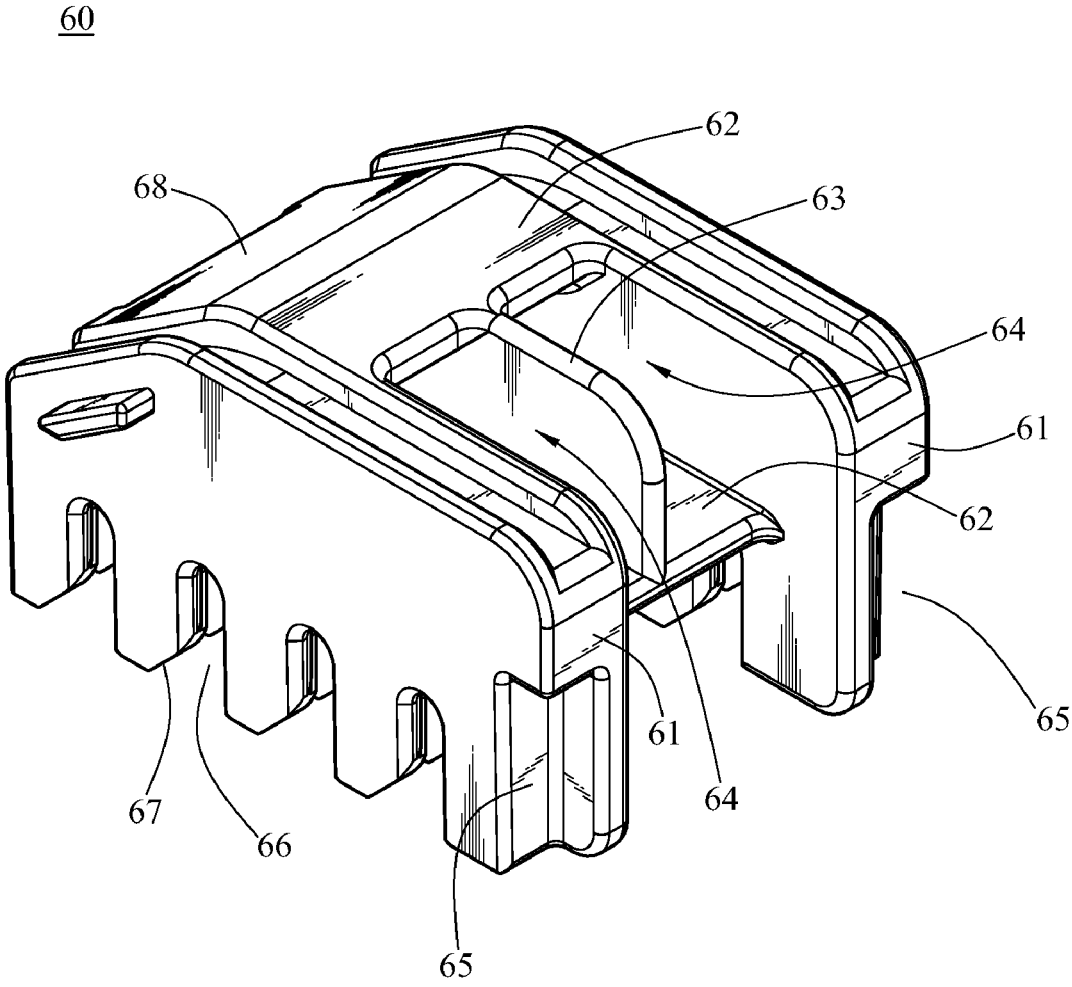
FIG. 7 is a schematic view of a terminal pressing member according to the present invention.
Figure 8:
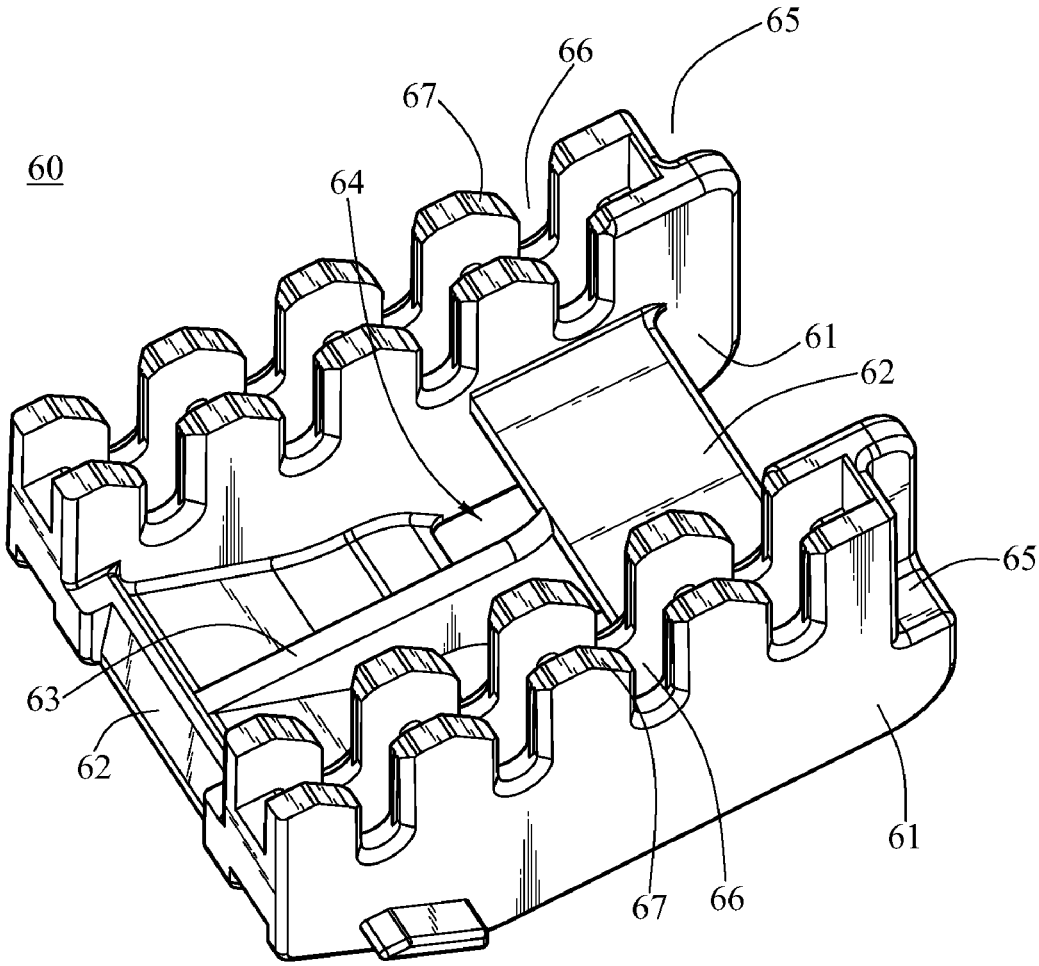
FIG. 8 is a schematic view of a terminal pressing member according to the present invention.
Figure 9:
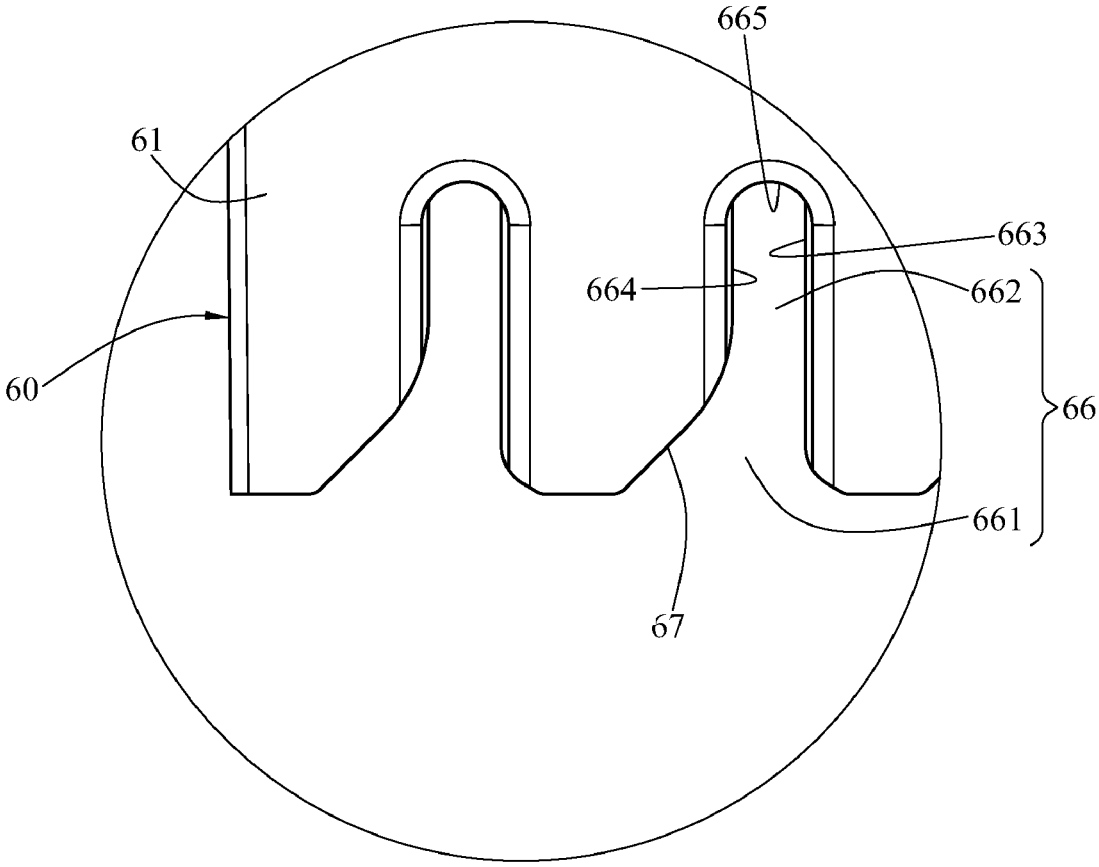
FIG. 9 is a schematic partial enlarged view of a terminal pressing member according to the present invention.
Figure 10:
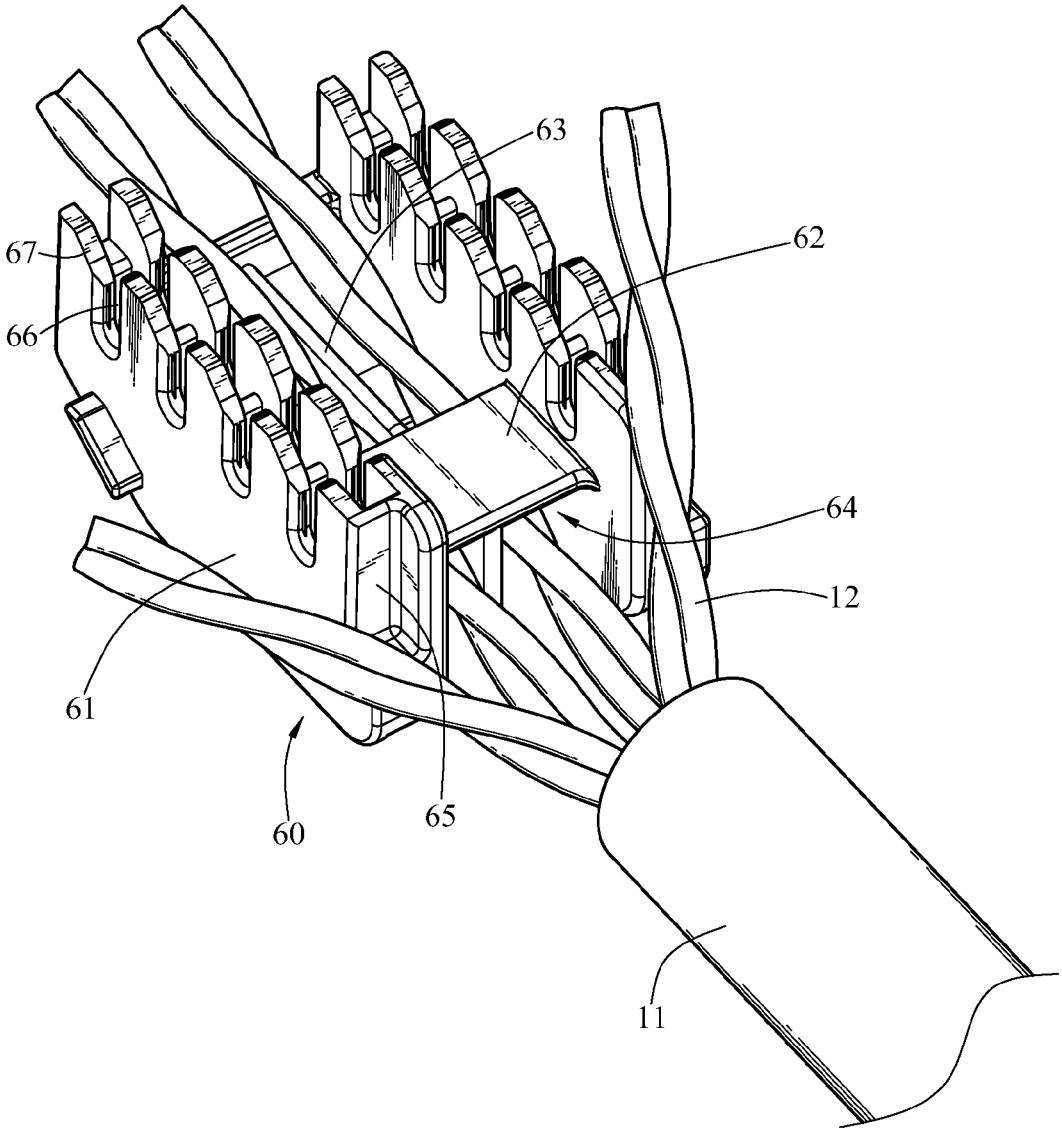
FIG. 10 is a schematic view of a terminal pressing member according to the present invention.
Figure 11:
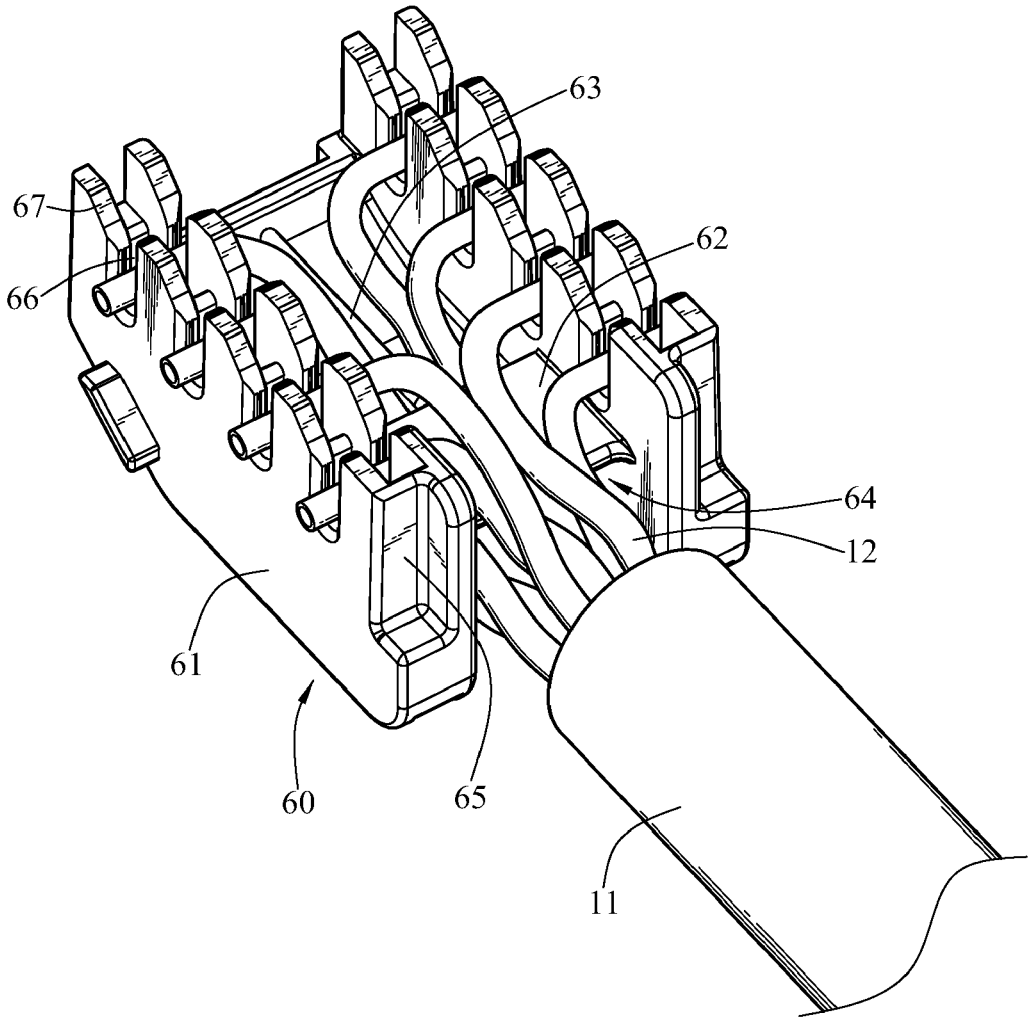
FIG. 11 is a schematic view of a terminal pressing member assembled with a cable according to the present invention.

Referring to FIGS. 3, 5, and 6, the cover 50 is pivoted to the base 10 and capable of rotating relative to the same. The cover 50 has two corresponding shaft holes 51 respectively fitted on the camshafts 24 of the outer housing 20. The cover 50 further has two hooks 52 that hook the edges of the base 10, so that the cover 50 can be firmly engaged with the base 10 as required.

Referring to FIGS. 11, 12, 13, 14, 15, and 16, the cable 13 is electrically connected to the contact terminals 34 of the slot 22 by inserting its adapter 14 into the slot 22 of the base 10. The terminal pressing member 60 is stacked on the accommodation groove 311 of the base 10 with its pressing slots 66 facing the piercing terminals 33 of the base 10. The cover 50 rotates towards the accommodation groove 311 and presses against the contact surface 68 of the terminal pressing member 60, such that the terminal pressing member 60 moves towards the accommodation groove 311. The ribs 314 of the base 10 are respectively engaged with the cut-out slots 65 of the terminal pressing member 60, and thus the terminal pressing member 60 is positioned in the accommodation groove 311. Continuously pressed by the cover 50, the pressing slots 66 of the terminal pressing member 60 respectively force the wires 12 to be embedded in the piercing terminals 33 on the base 10, such that the wires 12 are electrically connected to the piercing terminals 33, respectively. The piercing terminals 33 are adapted to cut the insulating layers of the corresponding wires 12, and contact and clamp the conducting wire materials of the wires 12. Thus, the cable 13 is electrically connected to the wires 12 of the cable 11 through the contact terminals 34 and the piercing terminals 33.

In the present invention, as each pressing slot of the terminal pressing member has a wire leading portion, a wire led by the wire leading portion can be successfully placed in the pressing slot during the assembly of the wires and the terminal pressing member. Moreover, the circumstances that it is difficult to place the wires in the pressing slots or the wires may easily fall off from the pressing slots can be avoided, and the overall assembly efficiency of the communication jack is enhanced.

What is claimed is:

1. A communication jack structure, adapted to electrically connect a cable and a plurality of wires, comprising:

a base, having an accommodation groove and a slot, wherein the accommodation groove is provided with two rows of piercing terminals, the slot is provided with a plurality of contact terminals electrically connected to the piercing terminals respectively, and the cable is inserted in the slot to electrically connect the contact terminals;

a terminal pressing member, having plural rows of pressing slots corresponding to the piercing terminals, wherein each pressing slot has a wire leading portion at an opening, the wire extends into the terminal pressing member along a wire connection direction, the wire leading portion located in the pressing slot opposite to the wire connection direction extends from an end edge of the opening of the pressing slot in a direction opposite to the wire connection direction and meanwhile inclines toward the bottom of the pressing slot, and the wire is led by the wire leading portion and placed into the bottom of the pressing slot from the opening; and a cover, pivoted to the base, wherein the cover rotates to press the terminal pressing member into the accommodation groove, such that the pressing slots respectively press the wires to be embedded in the piercing terminals, and the wires are electrically connected to the piercing terminals, respectively.

2. The communication jack structure according to claim 1, wherein each pressing slot has a short sidewall connected to the wire leading portion, a long sidewall facing the short sidewall, and a bottom wall connecting the short sidewall and the long sidewall, the long sidewall faces the wire connection direction and the short sidewall is in a direction opposite to the wire connection direction, and thus the pressing slot is divided into a holding section adjacent to the bottom wall and a guiding section adjacent to the wire leading portion.

3. The communication jack structure according to claim 2, wherein a ratio between a length of the wire leading portion projected on the long sidewall and a length of the long sidewall is in a range of 0.3 to 0.7.

4. The communication jack structure according to claim 1, wherein the terminal pressing member has two pressed blocks, two combination boards respectively connected to the pressed blocks, and a partition board connected to the combination boards, and two parallel through-slots are formed between the two pressed blocks by the combination boards and the partition board.

5. The communication jack structure according to claim 1, wherein the terminal pressing member has an inclined contact surface, and the cover presses against the contact surface to force the terminal pressing member to move towards the accommodation groove.

6. The communication jack structure according to claim 1, wherein the terminal pressing member has two cut-out slots, the accommodation groove has two ribs respectively disposed on two edges, and each rib is suited in the corresponding cut-out slot, such that the terminal pressing member is positioned in the accommodation groove.

7. The communication jack structure according to claim 1, wherein the base has a body and an outer housing fitted on the outside of the body, the body is provided with a plurality of embedded blocks, the outer housing is provided with a plurality of limiting holes, and the embedded blocks are respectively embedded into the corresponding limiting holes, such that the body is firmly engaged in the outer housing.

8. The communication jack structure according to claim 7, wherein the body comprises:

an inner housing, enclosing to form the accommodation groove; and a circuit board, engaged with the inner housing, wherein the contact terminals and the piercing terminals are electrically disposed on the circuit board and are electrically connected to each other through the circuit board, the piercing terminals penetrate the inner housing and extend into the accommodation groove, and one end of the contact terminal is bent towards the inner housing.

9. The communication jack structure according to claim 7, wherein the outer housing has two opposite camshafts, the cover has two shaft holes, and the shaft holes are respectively fitted on the camshafts.

10. The communication jack structure according to claim 1, wherein the cover has two hooks that hook the edges of the base.

* * * * *